US006208221B1

(12) United States Patent
Pelz et al.

(10) Patent No.: US 6,208,221 B1
(45) Date of Patent: Mar. 27, 2001

(54) MICROWAVE DIPLEXER ARRANGEMENT

(75) Inventors: Dieter Pelz; Natalie Trembath, both of North Croydon (AU)

(73) Assignee: Alcatel, Paris (FR)

( * ) Notice: Subject to any disclaimer, the term of this patent is extended or adjusted under 35 U.S.C. 154(b) by 0 days.

(21) Appl. No.: 09/310,861

(22) Filed: May 13, 1999

(30) Foreign Application Priority Data

May 14, 1998 (AU) ..... PP3532

(51) Int. Cl.[7] ..... H01P 5/12
(52) U.S. Cl. ..... 333/126; 333/212
(58) Field of Search ..... 333/126, 132, 333/134, 135, 202, 203, 206, 212

(56) References Cited

U.S. PATENT DOCUMENTS 3,693,115 * 9/1972 Edson ..... 333/73 R
4,937,533 * 6/1990 Livingston ..... 333/126
5,389,903 * 2/1995 Piirainen ..... 333/203
5,748,058 * 5/1998 Scott ..... 333/202
5,808,526 * 9/1998 Kaegebein ..... 333/202
6,025,764 * 2/2000 Pelz et al. ..... 333/202

* cited by examiner

*Primary Examiner*—Robert Pascal
*Assistant Examiner*—Kimberly E Glenn
(74) *Attorney, Agent, or Firm*—Sughrue, Mion, Zinn, Macpeak & Seas, PLLC

(57) ABSTRACT

An adjustable microwave diplexer comprising two combline filter sections (A and B). Each filter section has at least three tunable resonator elements (1,2,3 and 4). Non-adjacent resonator elements of one section (A) are inductively coupled by an adjustable coupling element (20,21), and non-adjacent resonator elements of the other section (B) are capacitively coupled by an adjustable capacitor element (31). This arrangement provides the means to achieve adjustable transmission zeros above the passband of filter A and below the passband of filter B to provide the diplexer with two highly selective filters.

17 Claims, 3 Drawing Sheets

MICROWAVE DIPLEXER ARRANGEMENT

BACKGROUND OF THE INVENTION

This invention relates to microwave diplexers, and in particular to a diplexer arrangement having high isolation between the transmit and receive ports when the transmit/receive frequency separation is small.

A diplexer is a combination of two bandpass filters having two separate transmit/receive ports and a common port. Isolation between the transmit and receive ports is required in order to isolate the relatively high power transmit signal from the relatively low power received signal. This isolation is measured at the passband of the filters and typically exceeds 80 dB. Diplexers are either fixed tuned or tunable over a range of transmit/receive frequencies by tuning the filter's resonators and adjusting, if necessary, its couplings. When a signal is applied to the transmitter port of the diplexer, it propagates through the transmit bandpass filter and reaches the common port. There, the adjacent receive bandpass filter, which is tuned to a lower or higher frequency, produces a very high impedance and hence the transmit signal passes through the common port where it sees a matched load. A very small amount of signal energy passing through the adjacent receive filter is attenuated by the receive bandpass filter's stop band attenuation. Hence, the isolation is a function of filter selectivity.

Bandpass filters provide attenuation for signals at frequencies outside the filter passband by reflection. The reflection of signals is caused by a mismatch condition provided by the filter. This mismatch condition increases towards frequencies away from the passband. Mismatch is a function of the impedance seen at the input of a filter. If the impedance vs frequency exhibits a singularity (a pole or a zero) at a certain frequency, then the transmission at that frequency will be zero total reflection, no transmission through the filter. Due to the non-ideal nature of filters, the transmission zeros actually appear as points of extremely high attenuation, instead of infinite attenuation.

Diplexers with Chebyshev bandpass filter responses are known. When the frequency separation between the transmit and receive ports is large, Chebyshev filters will provide sufficient selectivity and are easy to realise. However, with Chebyshev filters, stop band attenuation increases monotonically and therefore cannot be used for very small transmit/receive frequency separation, where sharp selectivities are required. To provide a practical diplexer that has very small transmit/receive frequency separation, two highly selective bandpass filters are necessary. To fulfil this requirement, it is mandatory to use bandpass filters with transmission zeros.

Combline filters with transmission zeros, created by couplings between non5 adjacent resonators are known and have been used in single filters, but are not commonly used in tunable diplexers because the required adjustability of the transmission zeros over the tuning frequency range of the diplexer is too difficult to achieve. Diplexers require that the correct location of the transmission zeros, relative to the filter's centre frequency, be maintained for each centre frequency within the diplexer's tuning range in order to provide the required isolation between the transmit and receive ports.

The difficulty in achieving adjustable transmission zeros in a diplexer having two combline filters is, that in order to create any desired transmission zeros above the pass band of one filter and below the passband of the other filter, one filter must include adjustable inductive cross-couplings between non-adjacent resonators, and the other filter must have adjustable capacitive cross-couplings between non-adjacent resonators. The filter containing inductive cross-couplings will have its transmission zeros above its passband, and the filter containing capacitive cross-couplings will have transmission zeros below its passband.

In the filter having inductive cross-couplings, due to the fact that one resonator may be common to both inductively cross-coupled sections, excessive interaction between these cross-couplings may occur and as a result one transmission zero may not be produced. Further, the inductive cross-couplings would normally be provided by wire loops, and the magnitude of cross-coupling provided by the loops is difficult to adjust.

Co-existence of the two capacitive cross-couplings with one resonator being common to both cross-couplings constitutes yet another problem, if independent adjustment is required.

SUMMARY OF THE INVENTION

It is therefore an object of the present invention to provide a diplexer arrangement having means to achieve adjustable transmission zeros above the passband of one of its bandpass filters and below the passband of its other bandpass filter, to provide the diplexer with two highly selective bandpass filters.

According to the invention, there is provided an adjustable microwave diplexer arrangement comprising a first combline filter section and a second combline filter section, each said filter section having at least three tunable resonator elements of which selected non-adjacent resonator elements of said first filter section are inductively cross-coupled by a respective adjustable inductive cross-coupling arrangement, and selected non-adjacent resonator elements of said second filter section are capacitively cross-coupled by a respective adjustable capacitive cross-coupling arrangement, wherein each said inductive cross-coupling arrangement comprises a moveable conductive element extending between associated non-adjacent resonator elements of said first filter section and in a spaced relationship therewith, each said conductive element being operatively attached to a first non-conductive manual adjustment means arranged to selectively vary said spaced relationship and thereby vary the magnitude of inductive cross coupling there between, and wherein each said capacitive cross-coupling arrangement comprises a movable capacitive element extending between associated non-adjacent resonators of said second filter section and in a spaced relationship therewith, each said capacitive element forming, with sections of its associated selected non-adjacent resonator elements, a variable capacitor means, each said capacitor element being operatively attached to a respective second non-conductive manual adjustment means arranged to selectively vary said spaced relationship between each capacitive element and said sections and thereby vary the magnitude of capacitive cross-coupling there between.

The present invention permits the construction of a diplexer arrangement of relatively small dimensions that has two highly selective bandpass filters, and capable of high isolation between transmit and receive ports when the transmit/receive frequency separation is small.

BRIEF DESCRIPTION OF THE DRAWING

In order that the invention may be readily carried into effect, embodiments thereof will now be described in relation to the accompanying drawings, in which.

DETAILED DESCRIPTION OF THE INVENTION

Figure 1:
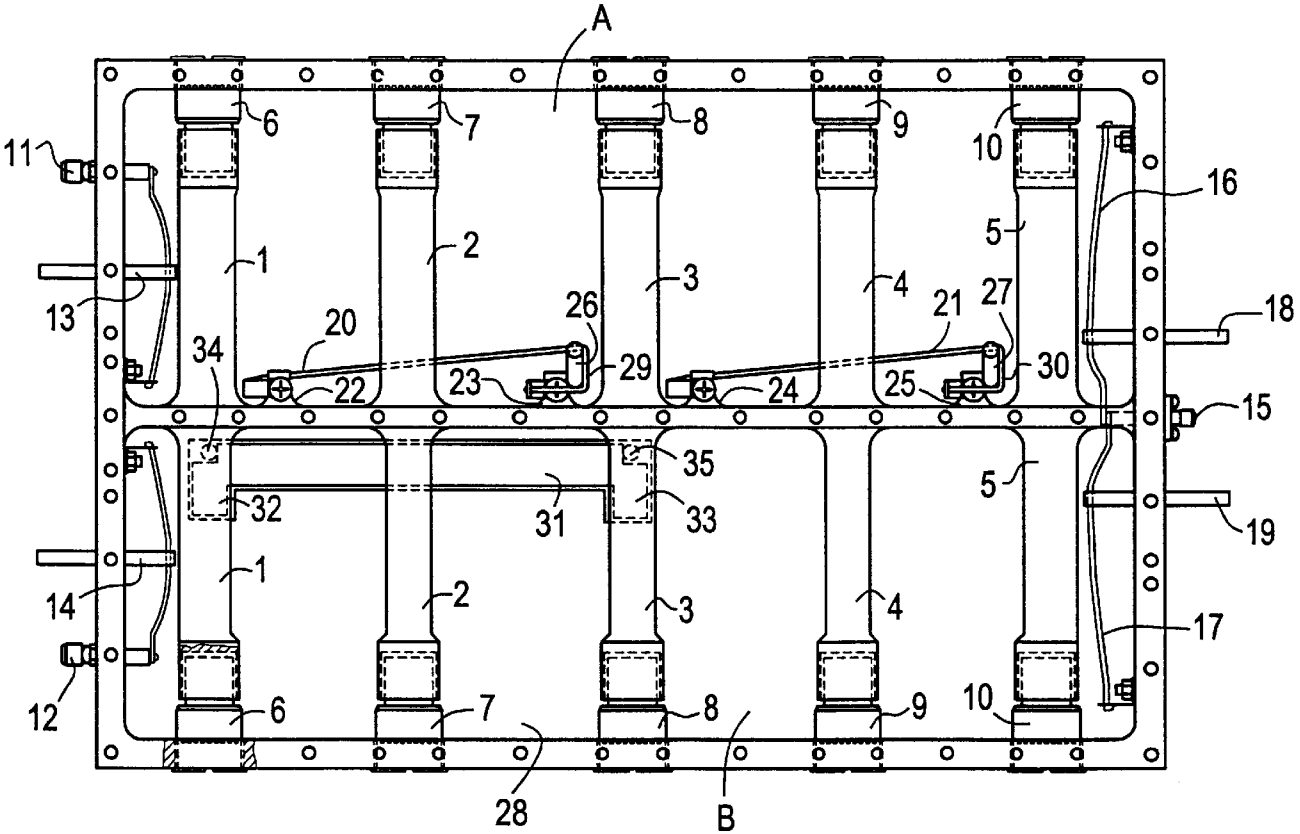
FIG. 1 shows a top view of a diplexer incorporating the adjustable cross-coupling arrangement of the present invention.

Referring to FIG. 1, the diplexer comprises transmit and receive sections A and B respectively in the form of two combline bandpass filters. Each said section comprises five resonator elements 1,2,3,4 and 5, each being provided with a variable tuning element 6,7,8,9 and 10. Transmit section A and receive section B have respective transmit and receive ports 11 and 12. Each port is provided with an adjustable coupling means 1 3 and 14 for coupling it to the associated filter. A common port 15 is diplexed to sections A and B via an internal harness comprising two transmission line couplings 16 and 17. Non-conducting elements 18 and 19, mounted in holes in the diplexer body provide non-invasive adjustability of the couplings between common port 15 and the filters. Non-adjacent resonators 1–3, 3–5 of section A are inductively cross-coupled by respective wire loops 20 and 21. The ends of each wire loop are attached, and electrically connected to a respective pair of spaced elevated areas of the diplexer 22–23, 24–25, that are adjacent resonators 1–3, 3–5.

Each wire loop is operatively connected to a non-conductive moveable rod 26,27 one end of which is slidably captive in an associated slot (not shown) in the diplexer's lid 28, and the other end of which is attached to the wire loop. The axes of the rods are perpendicular to the major surface of the lid and slidably moveable in a linear direction that is parallel to the axes of the resonators. Upon moving a rod, (26,27) the angle formed between a bend (29,30) in the wire loop (20,21) and the axes of the adjacent resonator (3,5) changes thereby changing the magnitude of the cross-coupling.

Figure 1B:
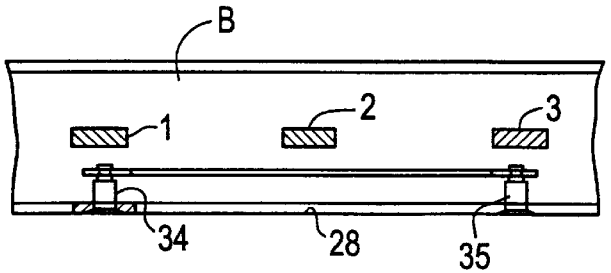
FIG. 1*b* shows a cross-section of part of the diplexer shown in FIG. 1, with details of one of the capacitive cross-coupling arrangements of the present invention.
Figure 1A:
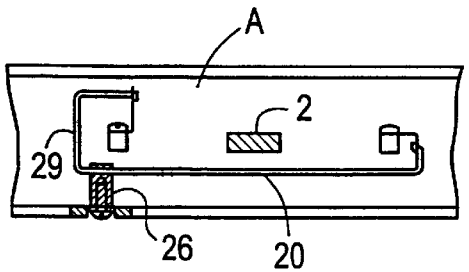
FIG. 1*a* shows a cross-section of part of the diplexer shown in FIG. 1, with details of the adjustable inductive cross-coupling arrangement of the present invention.

Non-adjacent resonators 1–3, 3–5 of section B are capacitively cross-coupled by respective rectangular printed circuit board (PCB) strips, one of which, 31, is shown in FIGS. 1 and 1*b*. Strip 31 has a conductive layer on one side thereof with enlarged areas 32 and 33 at each end for capacitively probing resonators 1 and 3. Adjustment elements 34 and 35 (FIG. 1*b*) of non-conductive material facilitate selective adjustment to vary the gap between the conductive layer on the strip and sections of resonators 1 and 3 of section B. Elements 34 and 35 also provide mechanical support for the strip, 31.

Figure 2:
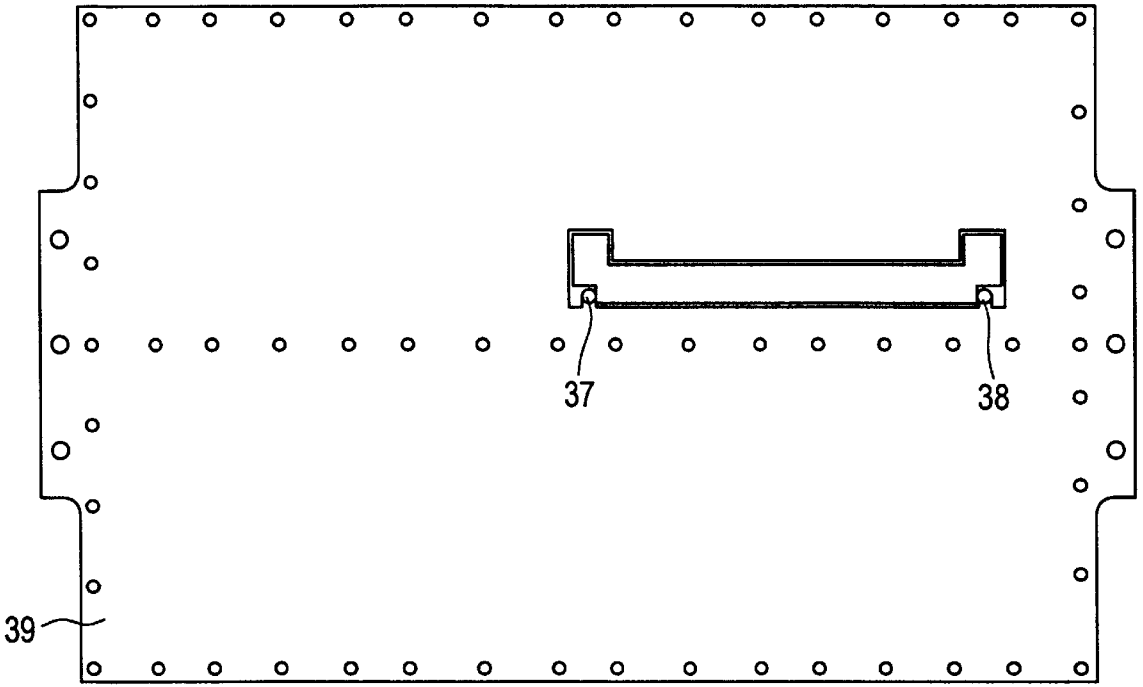
FIG. 2 is a top view of the diplexer's bottom panel (interior surface) and the other capacitive cross-coupling arrangement.
Figure 2A:
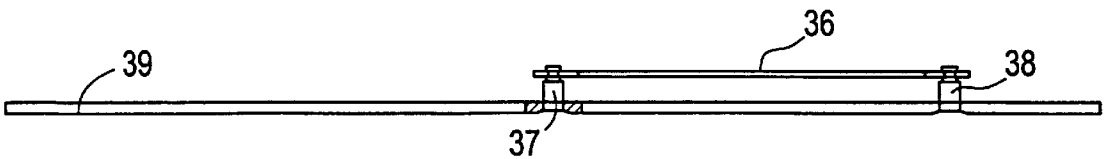
FIG. 2*a* is a side view of the panel shown in FIG. 2.

Resonators 3 and 5 of filter B are coupled by an identical strip 36 (see FIG. 2) which is mounted on a pair of non-conductive adjustment elements 37 and 38 operatively mounted in the removable metal bottom panel 39 of the diplexer. Strip 36 is mounted on the interior surface of panel 39 such that when the panel is screwed to the diplexer, the strip 36 is operatively located adjacent resonators 3, 4 and 5. The adjustment elements 37 and 38 extend through panel 39 to the exterior of the diplexer.

Figure 3:
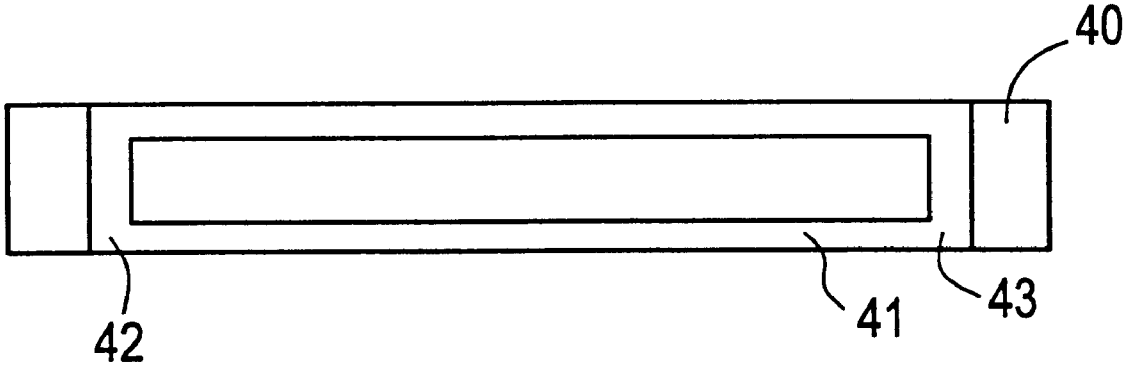
FIG. 3 shows an alternative inductive cross-coupling element.
Figure 3A:
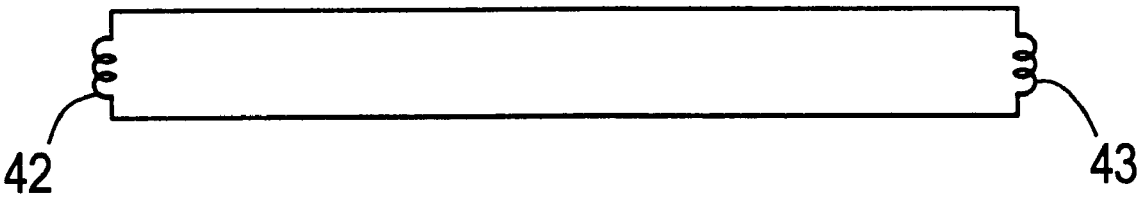
FIG. 3*a* shows an electrical equivalent of the inductive cross-coupling shown in FIG. 3.

An alternate way of realising adjustable inductive cross-coupling is to use the same mechanical technique as described above for capacitive cross-coupling. Referring to FIG. 3, a rectangular shaped PCB 40 is provided comprising a symmetrical transmission line metal layer 41, where end portions 42 and 43 act as coupling loops as shown in FIG. 3*a*. PCB 40 is mounted on a pair of adjustment elements (not shown) identical to elements 37 and 38 shown in FIG. 2, for the selective adjustment of the coupling magnitude between the non-adjacent resonators.

What is claimed is:

1. An adjustable microwave diplexer arrangement comprising:

a first combline filter section and a second combline filter section, each said filter section having at least three tunable resonator elements of which selected non-adjacent resonator elements of said first filter section are inductively cross-coupled by a respective adjustable inductive cross-coupling arrangement, and selected non-adjacent resonator elements of said second filter section are capacitively cross-coupled by a respective adjustable capacitive cross-coupling arrangement, wherein each said inductive cross-coupling arrangement comprises a moveable conductive element extending between associated non-adjacent resonator elements of said first filter section and in a spaced relationship therewith, each said conductive element being operatively attached to a first non-conductive manual adjustment means arranged to selectively vary said spaced relationship and thereby vary the magnitude of inductive cross coupling there between, and wherein each said capacitive cross-coupling arrangement comprises a movable capacitive element extending between associated non-adjacent resonators of said second filter section and in a spaced relationship therewith, each said capacitive element forming, with sections of its associated selected non-adjacent resonator elements, a variable capacitor means, each said capacitive element being operatively attached to a respective second non-conductive manual adjustment means arranged to selectively vary said spaced relationship between each capacitive element and said sections and thereby vary the magnitude of capacitive cross-coupling there between.

2. An adjustable microwave diplexer arrangement as claimed in claim 1, wherein said inductive cross-coupling arrangement comprises(a wire member extending between its associated non-adjacent resonator elements, one end of said wire member including a bent section which lies in a plane parallel to the axes of the resonator elements and proximate one of said associated non-adjacent resonator elements, said first non-conductive manual adjustment means being attached to said wire member such that movement of said adjustment means causes an angular displacement of said bent section relative to said one of said associated nonadjacent resonator elements, thereby changing the magnitude of cross-coupling between said associated non-adjacent resonator elements.

3. An adjustable microwave diplexer arrangement as claimed in claim 1, wherein said inductive cross-coupling arrangement comprises a first printed circuit board having a metal layer on one surface thereof in the form of a transmission line extending between its associated non-adjacent resonator elements, said first non-conductive manual adjustment means being attached to said first printed circuit board such that movement of the first non-conductive manual adjustment means causes said spaced relationship to change, thereby changing the magnitude of cross-coupling between said associated non-adjacent resonator elements.

4. An adjustable microwave diplexer arrangement as claimed in claim 1, wherein said capacitive cross-coupling arrangement comprises a second printed circuit board having a metal layer on one surface thereof and forming a capacitor plate element extending between its associated non-adjacent resonator elements whereby opposite end sections of said capacitor plate are proximate respective said associated non-adjacent resonator elements and capacitively coupled thereto, said second non-conductive manual adjustment means being attached to said second printed circuit board such that movement of said second non-conductive manual adjustment means causes the spaced relationship between associated non-adjacent resonator elements and said capacitor plate to change thereby changing the capacitive coupling.

5. An adjustable microwave diplexer arrangement as claimed in claim 4, wherein said end sections of said capacitor plate are larger in area than the area of said capacitor plate there between.

6. An adjustable microwave diplexer arrangement as claimed in claim 3, disposed in a metal enclosure means having at least one removable side panel.

7. An adjustable microwave diplexer arrangement as claimed in claim 6, wherein said first printed circuit board is operatively mounted on said side panel's interior surface.

8. An adjustable microwave diplexer arrangement as claimed in claim 7, wherein said first and said second non-conductive manual adjustment means are manually accessible from the metal enclosure means exterior.

9. An adjustable microwave diplexer arrangement as claimed in claim 4, disposed in a metal enclosure means having at least one removable panel.

10. An adjustable microwave diplexer arrangement as claimed in claim 9, wherein said second printed circuit board is operatively mounted on said side panel's interior surface.

11. An adjustable microwave diplexer arrangement as claimed in claim 10, wherein said first and said second non-conductive manual adjustment means are manually accessible from the metal enclosure means exterior.

12. An adjustable microwave diplexer comprising:

a first combline filter section having a first plurality of resonator elements;

a second combline filter section having a second plurality of resonator elements, said second combline filter section attached to said first combline filter section;

an inductive cross-coupling arrangement coupling non-adjacent resonator elements of said first plurality of resonator elements;

a capacitive cross-coupling arrangement coupling non-adjacent resonator elements of said second plurality of resonator elements; and adjustment means for adjusting said inductive cross-coupling arrangement and said capacitive cross-coupling arrangement.

13. The adjustable microwave diplexer according to claim 12, wherein said inductive cross-coupling arrangement comprises a moveable conductive element extending between said non-adjacent resonator elements of said first plurality of resonator elements.

14. The adjustable microwave diplexer according to claim 12, wherein said capacitive cross-coupling arrangement comprises a movable capacitive element extending between said non-adjacent resonators of said second plurality of resonator elements.

15. The adjustable microwave diplexer according to claim 13, wherein said moveable conductive element comprises a wire member.

16. The adjustable microwave diplexer according to claim 13, wherein said conductive element comprises a printed circuit board having a metal layer on a surface thereof.

17. The adjustable microwave diplexer according to claim 14, wherein said movable capacitive element comprises a printer circuit board having a metal layer on a surface thereof forming a capacitor plate element.

* * * * *